US005313717A

United States Patent [19]

Allen et al.

[11] Patent Number: 5,313,717

[45] Date of Patent: May 24, 1994

[54] REACTIVE ENERGY FLUID FILLED APPARATUS PROVIDING CUSHIONING, SUPPORT, STABILITY AND A CUSTOM FIT IN A SHOE

[75] Inventors: Bernie Allen, Wayland; Douglas E. Clark, Amesbury, both of Mass.; Christopher J. Edington, Derry, N.H.; Rui Parracho, Peabody; Eric Swartz, Malden, both of Mass.

[73] Assignee: Converse Inc., North Readings, Mass.

[21] Appl. No.: 810,844

[22] Filed: Dec. 20, 1991

[51] Int. Cl.[5] ..... A43B 13/20

[52] U.S. Cl. ..... 36/28; 36/29; 36/35 B; 36/37; 36/153

[58] Field of Search ..... 36/28, 29, 114, 35 R, 36/35 B, 37, 153, 91, 93

[56] References Cited

U.S. PATENT DOCUMENTS

| | | | |
|---|---|---|---|
| D. 297,980 | 10/1988 | Sugiyama . | |
| D. 300,084 | 3/1989 | Ito et al. . | |
| D. 300,085 | 3/1989 | Ito et al. . | |
| 1,193,608 | 8/1916 | Poulson | 36/29 |
| 1,605,985 | 11/1926 | Rasmussen | 36/29 |
| 2,080,499 | 5/1937 | Nathanson | 36/29 |
| 2,177,116 | 10/1939 | Persichino | 36/153 |
| 2,600,239 | 6/1952 | Gilbert | 36/153 |
| 2,762,134 | 9/1956 | Town | 36/153 |
| 3,765,422 | 10/1973 | Smith . | |
| 3,785,069 | 1/1974 | Brown . | |
| 3,795,994 | 3/1974 | Ava . | |
| 3,859,740 | 1/1975 | Kemp | 36/71 |
| 3,871,117 | 3/1975 | Richmond et al. . | |
| 3,914,881 | 10/1975 | Striegel . | |
| 4,008,530 | 2/1977 | Gager . | |
| 4,100,686 | 7/1978 | Sgarlato et al. | 36/29 |
| 4,123,855 | 11/1978 | Thedford . | |
| 4,129,951 | 12/1978 | Petrosky . | |
| 4,183,156 | 1/1980 | Rudy . | |
| 4,217,705 | 8/1980 | Donzis . | |
| 4,342,157 | 8/1982 | Gilbert . | |
| 4,361,969 | 12/1982 | Vermonet | 36/29 |
| 4,397,104 | 8/1983 | Doak . | |
| 4,414,760 | 11/1983 | Faiella . | |
| 4,423,735 | 1/1984 | Comparetto . | |
| 4,446,634 | 5/1984 | Johnson et al. . | |
| 4,458,430 | 7/1984 | Peterson . | |
| 4,471,538 | 9/1984 | Pomerantz et al. . | |
| 4,472,890 | 9/1984 | Gilbert . | |
| 4,567,677 | 2/1986 | Zona . | |
| 4,610,099 | 9/1986 | Signori . | |
| 4,744,157 | 5/1988 | Dubner . | |
| 4,768,295 | 9/1988 | Ito . | |
| 4,905,383 | 3/1990 | Beckett et al. . | |
| 4,934,070 | 6/1990 | Mauger . | |
| 4,934,072 | 6/1990 | Frederickson et al. . | |
| 4,936,029 | 6/1990 | Rudy . | |
| 5,010,662 | 4/1991 | Dabuzhsky et al. . | |
| 5,092,060 | 3/1992 | Frachey et al. | 36/29 |
| 5,097,607 | 3/1992 | Fredericksen | 36/29 |

FOREIGN PATENT DOCUMENTS

| | | | |
|---|---|---|---|
| 200963 | 5/1958 | Fed. Rep. of Germany | 36/153 |
| 2800359 | 7/1979 | Fed. Rep. of Germany | 36/28 |
| 9111931 | 8/1991 | PCT Int'l Appl. | 36/29 |
| 9116831 | 11/1991 | PCT Int'l Appl. | 36/29 |

*Primary Examiner*—Paul T. Sewell
*Assistant Examiner*—M. Denise Patterson
*Attorney, Agent, or Firm*—Rogers, Howell & Haferkamp

[57] ABSTRACT

A reactive energy fluid filled cushioning and stabilizing apparatus in a shoe is comprised of one or more anatomically shaped fluid filled bladders that are positioned in the forefoot, arch and/or heel areas of the shoe. The bladders assume a complementary custom fitting configuration to the contours of a foot inserted in the shoe. In variant embodiments of the apparatus, the fluid filled bladders are positioned separate from each other in the forefoot, arch and heel areas of the shoe and are interconnected in fluid communication by fluid conducting channels, or the bladders are positioned independent of each other in the forefoot, arch and heel areas of the shoe.

13 Claims, 3 Drawing Sheets

REACTIVE ENERGY FLUID FILLED APPARATUS PROVIDING CUSHIONING, SUPPORT, STABILITY AND A CUSTOM FIT IN A SHOE

BACKGROUND OF THE INVENTION

Field of the Invention

The present invention relates to a fluid-filled apparatus which reacts with the stimulus of an outside force, hereinafter referred to as a reactive energy apparatus, incorporated into a shoe sole and shoe upper that provides a custom fit to the shoe wearer's foot in addition to providing cushioning, support and stability to the shoe wearer's foot. In particular, the present invention pertains to an apparatus comprised of one more anatomically-shaped fluid-filled bladders that are positioned in the forefoot, arch and/or heel areas of a shoe and assume a complementary custom fitting configuration to the contours of a foot inserted in the shoe. In variant embodiments of the apparatus, the fluid-filled bladders are positioned separate from each other in the forefoot, arch and heel areas of the shoe and are interconnected in fluid communication by fluid-conducting channels, or the bladders are positioned independent of each other in the forefoot, arch and heel areas of the shoe.

Description of the Related Art

Various methods and devices have been employed in shoes in seeking to add cushioning to the shoe to absorb the shock of footstep impact in walking, running and other activities, and thereby provide some protection to the shoe wearer's foot. This is particularly true in athletic footwear where the foot is exposed to repeated shocks from footstep impact in running and other athletic activities. Various methods and devices have also been employed in shoes seeking to provide a custom fit of the shoe around the contours of the shoe wearer's foot while also providing support and stability to the foot. Typical prior art devices developed to provide cushioning, custom fit, support or stability to the foot inside a shoe range from merely constructing the shoe sole from a softer, more resilient material, to incorporating fluid filled pads or bladders in the sole of a shoe.

In many shoe soles designed to increase the cushioning effects of the sole, the increased resiliency or "softness" of the shoe sole provides little resistance to the tendency of the shoe wearer's foot to rotate relative to the leg upon footstep impact. In providing additional cushioning in the shoe sole, these shoes sacrifice or reduce the support and stability provided to the foot by the shoe sole.

In shoe soles employing fluid filled pads or bladders to provide cushioning to the foot, the particular fluid filled bladders employed are often incapable of providing cushioning to the foot for all of the varying magnitudes of force exerted on the foot and the varying areas of the foot subjected to the forces in footstep impacts in jogging, running and other athletic activities. Prior art fluid filled bladders are typically designed to provide cushioning in the particular area of the shoe sole where the bladder is located, for example in the heel or forefoot areas of the shoe sole. These prior art devices provide no cushioning for other areas of the shoe sole where footstep impact may occur. Many prior art fluid filled bladders are effective in providing cushioning to the foot only when the force of footstep impact is concentrated at the center of the fluid filled bladder. Should forces from footstep impact occur along the outer or inner edge of the runner's foot, as is very often the case, the footstep impact forces exerted on the outer or inner edges of the prior art fluid bladders often cause the fluid to be forced from these areas to other areas of the bladders. With the fluid having been forced from the inner or outer areas of the bladders, these bladders are incapable of providing any cushioning of the force of footstep impact along the inner or outer edges of the foot.

What is needed to overcome the above-described disadvantages of prior art shoes is a shoe employing an apparatus that provides a custom fit by assuming a shape complementary to the contours of a foot inserted into the shoe and provides cushioning to various areas of the foot in response to varying magnitudes of footstep impact force and varying areas of force concentration on the foot. What is also needed to overcome the above-described disadvantages is an apparatus in a shoe that stabilizes the foot in the shoe and reduces the forces of footstep impact concentrated on one particular area of the foot by distributing these forces over a greater area of the foot.

SUMMARY OF THE INVENTION

The present invention overcomes the above-described disadvantages associated with prior art shoes by providing a shoe comprising a reactive energy apparatus that provides cushioning, a custom fit, support and stability to a foot inserted into the shoe. The reactive energy apparatus enables the shoe to provide a supporting, custom fit to the foot of the shoe wearer, where the fit and support of the foot is dynamically changing as forces due to footstep impact are exerted on the foot.

The reactive energy apparatus of the present invention is generally comprised of fluid filled bladders provided in the forefoot, arch and heel areas of a shoe. The fluid filled bladders are provided in the interior of the shoe on the shoe sole, and on the shoe upper in an area adjacent the arch of the shoe wearer's foot. In variant embodiments of the invention the fluid filled bladders are connected in fluid communication with each other through several fluid conducting channels extending between the separate bladders, or are isolated from each others in the different areas of the shoe.

Each of the embodiments of the apparatus of the invention are described as being contained in an athletic shoe. However, the descriptions of the embodiments of the apparatus being employed in an athletic shoe are illustrative only and the various embodiments of the apparatus may be incorporated into various different types of shoes.

In each of the embodiments of the apparatus of the invention, the apparatus is comprised of one or more fluid filled forefoot, arch and heel bladders that are easily inserted into the sole of the shoe. The shoe sole is constructed with recessed cavities specifically configured to receive the forefoot, arch and heel bladders of the apparatus.

The apparatus is constructed of overlapping layers of a flexible, fluid tight, barrier material. The layers are bonded together along a peripheral boundary of the apparatus that extends completely around the one or more bladders of the apparatus. Each of the bladders are filled with a fluid. The top layer of the overlapping layers of each of the fluid filled bladders is formed with a plurality of depressions or clefts. The clefts extend from the top layer down through the fluid filled interior volumes of the bladders and are joined to the bottom layer inside the bladder interior volumes. The pluralities of clefts form fold lines in the bladders that enable the bladders to be easily folded along the lines of clefts in response to bending forces exerted on the bladders during activities performed while wearing the shoe.

The plurality of clefts also form spatially arranged wall segments in the interior volumes of the bladders. The wall segments restrict or control the rate of fluid flow through the bladders from one area to another area of the interior volumes of the bladders in response to forces exerted on the bladder during footstep impact. Spaces or openings between adjacent wall segment have calibrated cross-sectional areas that also regulate the rate of fluid flow through the bladders.

In the heel bladder of the apparatus a foam sponge is provided in the bladder interior volume. The foam sponge displaces a portion of the fluid filling the interior volume of the heel bladder and thereby reduces the weight of the heel bladder. The foam sponge also offers increased resistance or cushioning to forces exerted on the heel bladder due to footstep impacts.

In the embodiments of the apparatus comprising fluid conducting channels, the channels are formed between the overlapping layers of barrier material in the same manner as the bladders of the apparatus. The channels extend between the forefoot, arch and heel bladders and provide fluid communication between the fluid filled bladders. Each of the channels have cross-sectional areas calibrated to regulate the rate of fluid flow from one bladder to another bladder. The calibrated cross-sectional areas of the channels serves to retain a portion of the fluid in a bladder subjected to a force of footstep impact and thereby maintain the cushioning and support of that bladder provided to the forefoot, arch or heel areas of the foot, while enabling a portion of the fluid to be forced from the bladder to another bladder, causing the other bladder to expand slightly and exert a reactive force on other areas of the foot and thereby distribute the force of footstep impact over a greater area of the foot.

In operation of the apparatus, as forces of varying magnitudes are exerted on different areas of the shoe wearer's foot during running or other activities, the forces exerted on the bladders of the apparatus cause the fluid contained in the bladders to flow from one area of the bladders to another, and cause the fluid to flow from one of the bladders to another through the fluid conducting channels. The flow of fluid to other bladders or other areas of the bladders cause those bladders or bladder areas to expand. The expansion of the bladders and bladder areas exerts a reactive force on the bottom of the shoe wearer's foot at areas of the foot away from the area where the forces of footstep impact are concentrated. In this manner, the apparatus of the invention provides a continuous supporting, custom fit to the shoe wearer's foot while distributing forces due to footstep impact over a greater area of the shoe wearer's foot.

BRIEF DESCRIPTION OF THE DRAWINGS

Further objects and features of the present invention are revealed in the following Detailed Description of the Preferred Embodiment of the invention and in the drawings figures wherein.

DETAILED DESCRIPTION OF THE PREFERRED EMBODIMENT

Figure 1:
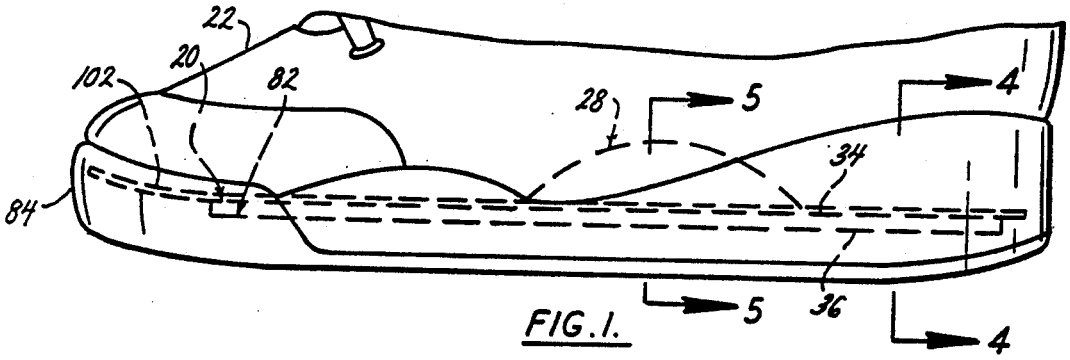
FIG. 1 is a side elevation view of a shoe employing the reactive energy apparatus of the present invention showing the relative position of the apparatus in the shoe.
Figure 2:
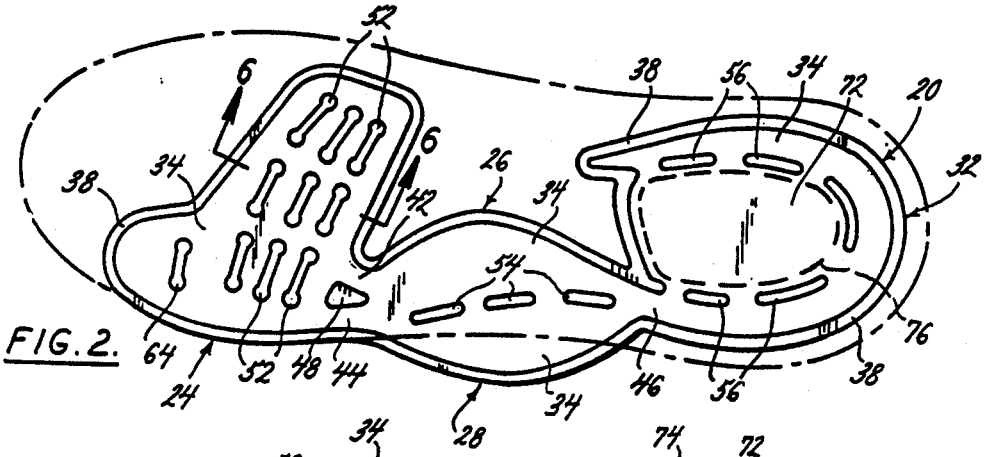
FIG. 2 is a plan view of the apparatus of the invention showing the position of the apparatus in the shoe sole depicted by phantom lines.

The reactive energy fluid filled apparatus 20 of the present invention is shown in one operative environment of the apparatus in FIGS. 1 and 2. The apparatus is constructed from a flexible, fluid-tight barrier material, preferably a plastic-type film that is capable of being bonded. Although polyurethane is preferred, other types of flexible, fluid-tight barrier materials may be employed in constructing the apparatus of the invention without departing from the intended scope of the claims. In the preferred embodiment of the invention shown in the drawing figures, the apparatus 20 is employed with an athletic shoe 22. However, the apparatus of the invention is equally adapted for use with shoes other than the athletic shoe shown, and its description of being employed with an athletic shoe is illustrative only and should not be interpreted as limiting.

In the embodiment of the apparatus shown in FIGS. 1 and 2, the apparatus 20 is comprised of a first, forefoot bladder 24, a second, arch bladder 26, a third, upper arch bladder 28, and a fourth, heel bladder 32. Each of the four bladders of the apparatus 20 may be constructed with one or more interior chambers containing a fluid. In the embodiment of the invention to be described, only the heel bladder 32 is comprised of two interior chambers. The forefoot bladder 24, the arch bladder 26, and the upper arch bladder 28 all are constructed having a single fluid-filled interior chamber.

The four hollow bladders 24, 26, 28, 32 are formed as component parts of a single unit of the apparatus 20, the apparatus being constructed from a pair of overlapping layers 34, 36 of a flexible, fluid-tight barrier material. As is best seen in FIG. 2, the overlapping pair of material layers 34, 36 have a peripheral boundary 38 that is formed in a specific configuration to give each of the four bladders of the apparatus an anatomically-shaped outline that is complementary to the forefoot, arch, and heel areas of the bottom of a foot. The top layer 34 of the apparatus has a predetermined surface configuration molded into it, where the bottom layer 36 is substantially flat. The configurations of the shapes molded into the top layer 34 form the four bladders and a pair of fluid-conducting channels 42, 44 communicating the interior volume of the forefoot bladder 24 with the interior volumes of the arch and upper arch bladders 26, 28, and a fluid-conducting channel 46 communicating the interior volume of the heel bladder 32 with the interior volumes of the arch and upper arch bladders.

Each of the forefoot, arch, upper arch and heel bladders, and each of the fluid-conducting channels, are formed when the top layer 34 of material is secured to the bottom layer 36 in the relative positions of the two layers shown in the drawing figures. The molded configurations formed in the top layer 34 of material serve as flexible sidewalls or surfaces of each of the four bladders of the apparatus. The shapes may be molded into the top layer by any known method. The particular configurations of the four bladders shown in the drawing figures enable the apparatus to cushion a foot inserted in the shoe 22 employing the apparatus, and enable the shoe to provide support, stability and a custom fit to the foot inserted in the shoe.

The overlapping top and bottom layers of material 34, 36 are sealed together along the peripheral flange 38 that completely surrounds and defines the borders of the four bladders 24, 26, 28, 32 and the fluid-conducting channels 42, 44, 46 extending between the bladders. Sealing the peripheral flange 38 of the apparatus encloses the interior volumes of the bladders 24, 26, 28, 32 and the channels 42, 44, 46 between the two material layers. The top and bottom layers may be sealed together in the area of the flange 38 by adhesives, by radio frequency (RF) welding, or by other equivalent methods. The seal formed at the peripheral flange 38 is fluid-tight and forms a completely enclosed interior volume in each of the bladders 24, 26, 28, 32. Although the bladders, except for the heel bladder 32, are described as enclosing only one interior chamber each, in variant embodiments of the invention the bladders may enclose two or more separate chambers that may or may not be interconnected in fluid communication with each other.

Additional overlapping areas of the pair of material layers 34, 36 inside the apparatus peripheral boundary 38 are also secured together. As seen in FIG. 2, the top and bottom layers 34, 36 are secured together at an area 48 of the two layers between the pair of fluid-conducting channels 42, 44 communicating the forefoot bladder 24 interior volume with the arch and upper arch bladder 26, 28 interior volumes. The sealed area 48 of the two layers not only separates the pair of fluid-conducting channels 42, 44, but also serves to calibrate the cross-sectional area of the fluid-conducting channels 42, 44. The calibration of the cross-sectional areas of the two channels 42, 44 enables the channels to control the rate of fluid flow between the forefoot bladder 24 and the arch and upper arch bladders 26, 28. The channel 46 provides fluid communication between the arch and upper arch bladders 26, 28 and the heel bladder 32. Each of the channels 42, 44, 46 are formed by the molded configuration of the top layer of material 34 and the portions of the sealed peripheral flange 38 on opposite sides of the channels and the sealed area 48 of the layers between the forward pair of channels 42, 44.

Each of the bladders is filled with a moderately viscus fluid 50. Several different types of fluids may be employed as the fluid filling the bladders. The fluid could include a composition of two fluids having different viscosities, or the fluid could include solids, including but not limited to hollow spheres or particles suspended in the fluid.

Pluralities of clefts 52 are formed in the top layer of material 34 covering the forefoot bladder 24. A second plurality of clefts 54 is also formed in the top layer 34 separating the arch bladder 26 from the upper arch bladder 28. A third plurality of clefts 56 is formed in the top layer 34 of the heel bladder 32.

The forefoot bladder clefts 52 are formed in the top layer 34 of the forefoot bladder and extend downward into the interior volume 62 of the forefoot bladder to the bottom layer 36 of material. As seen in the drawing figures, each of the forefoot clefts 52 are formed as indentations or depressions in the top layer 34 of material. Each of the clefts 52 have set lengths arranged end to end in rows that extend laterally across the forefoot bladder 24, and are arranged side by side in columns that extend longitudinally across the top layer of the bladder. The depressions of the clefts 52 extend downward below the top layer 34 of material, through the fluid 50 filling the interior volume 62 of the forefoot bladder, and the bottoms of each of the clefts 52 are secured to the bottom layer 36 of material. The bottoms of the clefts may be sealed to the bottom layer of material by adhesives, by radio frequency welding, or by other equivalent methods.

By forming the clefts 52 in the top layer 34 of the forefoot bladder in the manner described above, and by arranging the plurality of forefoot clefts 52 in an array of rows extending laterally across the bladder and in columns extending longitudinally across the bladder, the rows of clefts form lateral fold lines extending across the top layer 34 of the forefoot bladder 24. The fold lines formed by the clefts 52 facilitate the folding or bending of the forefoot bladder 24 along the fold lines formed by the clefts. This enables the forefoot bladder 24 to be folded over at the cleft fold lines when the forefoot area of the shoe 22 is bent in walking or running activities.

A portion of the forefoot pad 24 extends forward in an area of the pad corresponding to the position of the hallux digit of the foot. An additional cleft 64 is provided in the top layer 34 of the forefoot pad in the hallux area of the pad. Like the rows and columns of clefts 52 described earlier, the hallux cleft 64 facilitates the bending of the forefoot bladder 24 in the hallux area of the bladder.

In addition to forming lateral fold lines across the forefoot bladder 24, the plurality of clefts 52 form wall segments having opposite sides and opposite ends in the interior volume 62 of the bladder. The wall segments formed by each of the clefts 52 in the interior of the forefoot bladder 62 divide the interior volume into separate areas and secure the top layer 34 to the bottom layer 36 in a spaced relationship preventing excessive expansion of the top layer from the bottom layer when the fluid 50 contained in the apparatus 20 is caused to flow into the forefoot bladder.

The plurality of wall sections formed by the clefts 52 in the forefoot bladder interior 62 also serve as flow restriction devices that impede the free flow of the fluid through the interior of the forefoot pad. The spaces or openings between the ends of adjacent wall segments formed by the clefts have cross-sectional areas that are calibrated to limit the rate of fluid flow through the openings. When a force from foot impact is exerted on the top layer 34 of the forefoot bladder 24, the interior volume 62 of the bladder is caused to decrease. The decrease in the forefoot bladder interior volume 62 will cause the fluid 50 to flow through the channels 42, 48 from the bladder interior. If an appreciable amount of the fluid is allowed to flow out of the bladders at the instant a footstep force is exerted on the bladder it would significantly decrease the ability of the forefoot bladder to cushion the foot against footstep shocks. By providing the plurality of wall segments formed by the clefts 52 in the interior volume 62 of the forefoot bladder, the free flow of fluid from the bladder interior 62 through the channels 42, 44 is restricted by the wall segments. As a result, the fluid is prevented from flowing quickly out of the forefoot bladder interior volume 62 and the bladder retains a portion of the fluid in its interior and thereby retains its ability to cushion footfall shocks.

The calibrated openings between adjacent wall segments formed by the plurality of clefts 52 also control the rate of fluid flow through the interior of the forefoot bladder 24 to maintain a portion of the fluid in an area of the bladder interior where a force from footstep impact is exerted, thereby maintaining the cushioning and support for the foot in this area of the bladder. The flow of fluid from the area of the forefoot bladder interior subjected to the force of foot impact, through the openings between adjacent wall segments formed by the clefts 52, to other areas of the bladder interior causes the expansion of the bladder in those other areas. The expansion of the other areas of the bladder results in these areas exerting a reactive force on the bottom of the shoe wearer's foot, thereby distributing the force of footstep impact over a greater area of the bottom of the forefoot area of the foot and decreasing the shock of foot impact.

The arch and upper arch bladders 26, 28 communicate in fluid communication with the forefoot bladder 24 through the fluid-conducting channels 42, 44. The rate at which the fluid is capable of flowing between the arch and upper arch bladders 26, 28 and the forefoot bladder 24 is dependent on the calibrated cross-sectional areas of the two channels 42, 44. The cross-sectional areas of the two channels are dimensioned to enable the fluid to flow between the bladders. However, the cross-sectional areas of the channels 42, 44 limit the rate at which fluid is forced out of the forefoot bladder interior volume 62 by a force exerted on the top layer 34 of the bladder in order to retain a certain amount of fluid inside the forefoot bladder 24 to cushion the shock of the force exerted on the forefoot area of the foot due to footstep impact.

As stated earlier, the arch and upper arch bladders 26, 28 are given a configuration complementary to the configuration of the arch area of a foot. When assembled in the shoe 22, the arch bladder 26 and upper arch bladder 28 engage in surface contact along the underside and medial side of the foot arch and provide a custom fit of the shoe in this area of the foot in addition to supporting and cushioning the foot arch.

The second plurality of clefts 54 extending between the arch bladder 26 and the upper arch bladder 28 are formed in substantially the same manner as the first plurality of clefts 52 extending across the forefoot bladder. The second plurality of clefts 54 are formed in the top layer 34 of material as indentations or depressions in the top layer. The clefts 54 extend downward below the top layer 34, through the fluid 50 filling the interior volume 66 of the arch bladder and upper arch bladder, and are secured to the bottom layer 36 of material in the same manner as the first plurality of clefts. The second plurality of clefts 54 form a fold line between the arch bladder 26 and the upper arch bladder 28. The fold line formed by the second plurality of clefts 54 enables the upper arch bladder 28 to be folded in a position above and adjacent to the arch bladder 26. This enables the upper arch bladder 28 to be mounted in the upper portion of the shoe 22 adjacent the arch of the shoe wearer's foot while the arch bladder 26 is mounted on the sole of the shoe just below the arch of the shoe wearer's foot.

Like the clefts 52 of the forefoot bladder 24, the second plurality of clefts 54 also serve as wall segments that divide the interior volume 66 of the arch and upper arch bladders. The wall segments formed by the second plurality of clefts 54 restrict and control the rate of fluid flow between the arch bladder 26 and the upper arch bladder 28. The spacing or openings between adjacent wall segments formed by the clefts 54 is calibrated to control the flow of fluid between the arch and upper arch bladders. The calibration of the openings between adjacent clefts 54 restricts or limits the rate of fluid flow from one of the arch and upper arch bladders to the other of the bladders in response to a force being exerted on the one arch or upper arch bladder. This maintains a certain amount of fluid inside the interior volume 66 of the arch or upper arch bladder to provide support and cushioning to the foot arch during running or other activities that would cause the foot arch to exert a force on the arch or upper arch bladders. The flow of fluid from one of the arch and upper arch bladders on which a footstep force is exerted, to the other of the arch or upper arch bladders causes the other bladder to expand slightly. The expansion of the other bladder causes that bladder to exert a reactive force on the foot in the arch area of the foot. The reactive force exerted by the other bladder serves to distribute the force of footstep impact over a greater area of the arch of the foot and thereby decreases the shock of footstep impact on the foot.

The heel bladder 32 communicates in fluid communication with the arch bladder 26 and upper arch bladder 28 through the fluid-conducting channel 46. The channel 46 is formed in the apparatus 20 with a predetermined cross-sectional area. The cross-sectional area of the channel 26 is chosen to control the rate of fluid flow between the arch and upper arch bladders 26, 28 and the heel bladder 32. The cross-sectional area of the channel 46 limits the rate at which fluid may be forced out of the interior volumes 66 of the arch bladders into the heel bladder, or out of the interior volume 68 of the heel bladder into the arch bladders, in response to a force being exerted on the bladders. This maintains a certain amount of fluid inside the bladder on which the force is exerted, thereby enabling the bladder to maintain its cushioning and support for the portion the foot exerting the force.

Figure 3:
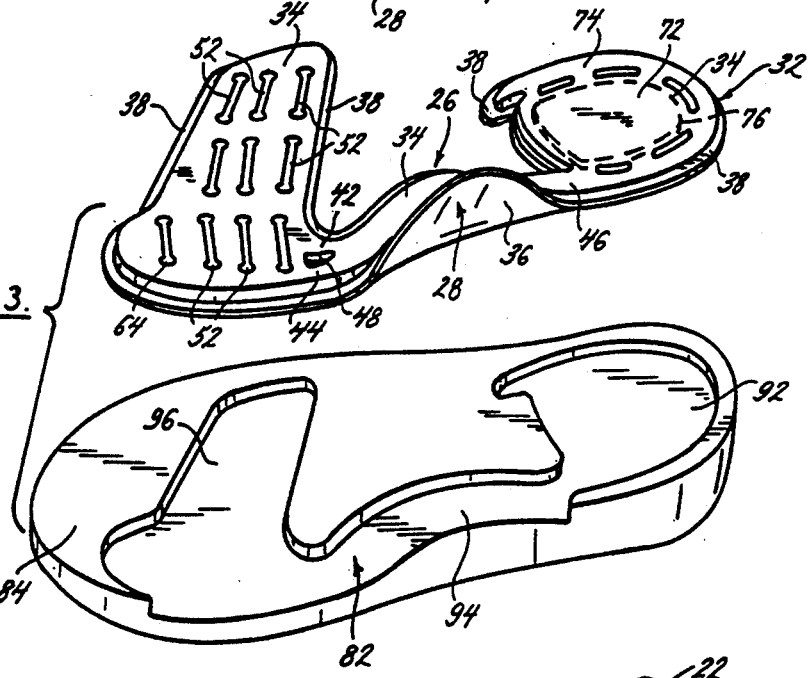
FIG. 3 is a perspective view of the shoe sole and the apparatus of the invention.
Figure 4:
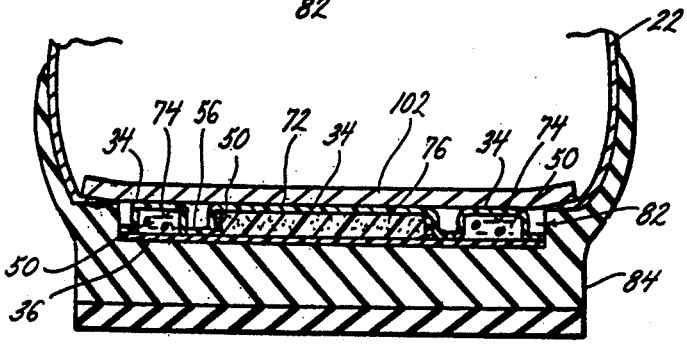
FIG. 4 is a partial end elevation view, in section, of the shoe sole and the apparatus of the invention taken along the line 4—4 of FIG. 1.

The heel bladder 32 is formed in two separate chambers, a center chamber 72 and a rim chamber 74. The center chamber 72 is separated from the rim chamber 74 by the third plurality of clefts 56. Like the previously described clefts of the forefoot bladder 24 and the arch and upper arch bladders 26, 28, the third plurality of clefts 56 are formed as indentations or depressions in the top layer 34 of material. The depressions extend downward from the top layer 34, through the fluid 50 filling the interior volume 68 of the heel bladder, and are joined to the bottom layer 36 of material in the same manner as described above in reference to the clefts of the forefoot bladder. As seen in FIGS. 2 and 3, the third plurality of clefts 56 extend in a general U shape around the heel bladder separating the center chamber 72 of the bladder from the rim chamber 74. The third plurality of clefts 56 also serve to connect the top layer 34 of the heel bladder to the bottom layer 36 in a spaced relationship and prevent excessive expansion of the center and rim chambers of the heel bladder as fluid enters the chambers.

A resilient pad 76 is provided in the interior volume 66 of the center chamber 72. In the preferred embodiment of the invention, the resilient pad 76 is formed of a resilient foam sponge material. However, the pad may be constructed of other similar types of resilient materials. The purpose of the pad is to add cushioning to the center chamber 72 of the heel bladder in addition to the cushioning provided by the fluid 50 filling the chamber. The presence of the pad 76 inside the center chamber 72 also displaces fluid 50 from the center chamber, and thereby reduces the weight of the heel bladder.

Like the previously described clefts of the forefoot and arch bladders, the third plurality of clefts 56 are spaced from each other a predetermined distance forming calibrated openings between adjacent clefts. This enables the clefts to serve as wall segments extending between the top and bottom layers of the heel bladder with fluid flow restricting openings being provided between adjacent wall segments. The openings between adjacent clefts 56 have cross-sectional areas calibrated to control the rate of fluid flow between the center chamber 72 and the rim chamber 74 of the heel bladder. The calibrated cross-sectional areas of the spaces between adjacent clefts 56 in the interior of the heel bladder 32, and the calibrated cross-sectional area of the channel 46 communicating the heel bladder with the forefoot and the arch bladders, control the rate at which the fluid 50 is forced from the interior volume 68 of the heel bladder in response to a force being exerted on the heel bladder, and thereby maintains the ability of the heel bladder to cushion the foot heel against the shock of footstep impact and to support and stabilizes the foot heel in the heel area of the shoe.

The U-shaped or horseshoe-shaped configuration of the rim chamber enables the rim chamber to provide a stabilizing, reactive force to the bottom of the foot in response to footstep impacts. For example, as a footstep impact force is exerted on the rim chamber 74 adjacent the arch area or along the inside of the foot, the inside portion of the rim chamber will compress forcing the fluid contained in the heel bladder to move around the rim chamber to the opposite side of the chamber. Because the spacing between adjacent clefts 56 of the heel bladder restricts the free flow of fluid between the adjacent clefts, the fluid flows more readily around the rim chamber 74 to the opposite side of the rim chamber from the side on which the force of foot impact is exerted. The flow of fluid to the opposite side of the rim chamber will cause the fluid pressure to increase on the opposite side and cause this side of the bladder to expand slightly, exerting a reactive force against the opposite side of the foot heel bottom from the side exerting the force on the heel bladder. This causes a redistribution of the force of impact over a greater area of the foot heel and stabilizes the foot heel in the shoe. Should the footstep impact occur at the opposite side or outside of the heel bladder, the force exerted on this side of the heel bladder will cause the heel bladder to compress on this side. This, in turn, will cause the fluid contained at the compressed side of the heel bladder to flow around the rim chamber to the opposite side or inside of the rim chamber, causing fluid pressure to increase and causing this side of the rim chamber to expand. This expansion exerts a reactive force on the inside of the foot heel stabilizing the foot heal and redistributing the force of impact over a greater area of the foot heel. By distributing the force of footstep impact occurring on the edges of the shoe sole over an increased area of the foot heel, the heel bladder serves to stabilize and support the foot heel in its reaction to the off-center footstep impact.

The reactive energy distributing function of the apparatus 20 is performed in substantially the same manner between the several fluid-filled bladders of the apparatus. When a footstep impact force is exerted on the heel bladder 32 of the apparatus, the fluid contained in the heel bladder is forced from the bladder through the channel 46 to the arch bladders 26, 28 and the forefoot bladder 24. The fluid supplied from the heel bladder to the arch and forefoot bladders causes the arch and forefoot bladders to expand slightly from their at-rest configurations. The expansion of the arch and the forefoot bladders exert reactive forces on the bottom of the foot at the forefoot and arch areas of the foot, thereby distributing the force of footstep impact concentrated in the heel of the foot over the arch and forefoot areas of the foot.

When a footstep impact force is exerted on the arch bladders 26, 28 of the apparatus, the fluid contained in the arch bladders is forced from the bladders through the channels 42, 44 to the forefoot bladder 24 and through the channel 46 to the heel bladder 32. The fluid supplied from the arch bladders to the forefoot and heel bladders causes the forefoot and heel bladders to expand slightly from their at-rest configurations. The expansion of the forefoot and heel bladders exert reactive forces on the bottom of the foot at the forefoot and heel areas of the foot, thereby distributing the force of footstep impact concentrated at the arch area of the foot over the forefoot and heel areas of the foot.

In the operation of the forefoot bladder 24, as a force of footstep impact is exerted on the bladder the bladder compresses, forcing the fluid 50 contained in the interior volume 62 of the bladder out through the fluid-conducting channels 42, 44. As explained earlier, the cross-sectional areas of the channels 42, 44 are calibrated to restrict the free flow of fluid through the channels. The calibration of the channels limits the rate at which fluid may exit the interior volume 62 of the forefoot bladder, causing a portion of the fluid to be retained in the bladder as a force is exerted on the bladder. The portion of fluid forced out of the forefoot bladder interior 62 fills the arch bladders 26, 28 and the heel bladder 32 causing these bladders to expand slightly. The expansion of the arch and heel bladders exerts a reactive force on the bottom of the shoe wearer's foot in the area of the arch and heel. This reactive force serves to distribute the impact force on the forefoot area of the foot over the arch and heel areas of the foot, thereby reducing the impact shock on the foot. The number of clefts 52 provided in the forefoot bladder 24 and the spacing between adjacent clefts also serve to restrict the rate of fluid flow from the interior volume 62 of the bladder in response to a force exerted on the bladder. By maintaining a portion of the fluid inside the forefoot bladder interior 62 as a force is exerted on the bladder, the bladder retains its ability to cushion and support the forefoot area of the shoe wearer's foot.

To position the apparatus of the invention 20 in the sole of the shoe 22, a recessed cavity 82 is formed in a top surface of the shoe sole 84. As seen in FIG. 3, the recessed cavity 82 is given an outline configuration substantially identical to the outline configuration of the apparatus 20. The only exception being that there is no space provided in the recessed cavity 82 for the upper arch bladder 28 of the apparatus. This is so because the upper arch bladder 28 is mounted against the shoe upper 86 in a position just above the arch bladder 26 received in the recessed cavity 82 of the shoe sole. In the shoe construction shown in the drawing figures, the recessed cavity 82 is formed in a top surface of the shoe midsole 84. The apparatus 20 is received in the cavity 82 with the heel bladder 32 positioned in a heel portion 92 of the cavity, the arch bladder 26 positioned in an arch position 94 of the cavity, and the forefoot bladder 24 positioned in a forefoot portion 96 of the cavity.

Figure 5:
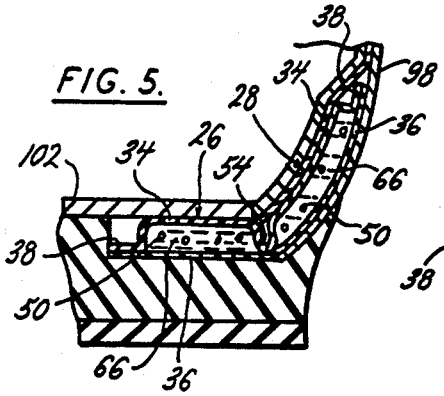
FIG. 5 is a partial end elevation view, in section, showing the shoe sole and the apparatus of the invention in the shoe sole taken along the line 5—5 of FIG. 1.

In positioning the apparatus 20 in the midsole cavity 82, the upper arch bladder 28 is folded over at the second plurality of clefts 52 and is positioned at an angle relative to and above the arch bladder 26. The relative positions of the arch bladder 26 and upper arch bladder 28 when inserted into the shoe are best seen in FIG. 5. In this position of the bladders, it is seen that the upper arch bladder 28 does not rest on the midsole 84 as does the arch bladder 26, but rests against an interior surface of the shoe upper 98. With the apparatus positioned in the recessed cavity 82 of the shoe midsole 84, the shoe insole is positioned over the top surface of the midsole 84 and covers over the apparatus 20. An arch extension of the insole 102 also extends over and covers the upper arch bladder 28 in the shoe interior.

Figure 7:
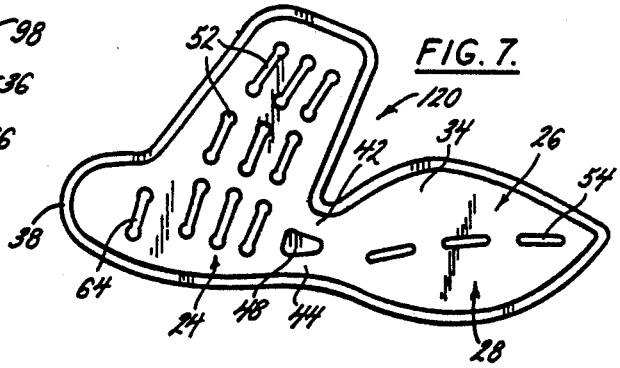
FIG. 7 is a plan view of a variant embodiment of the apparatus of the invention.
Figure 6:
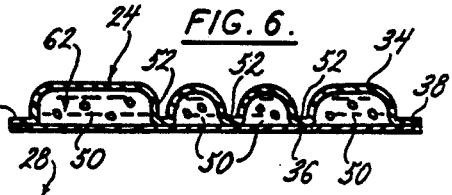
FIG. 6 is an elevation view, in section, of the apparatus of the invention taken along the line 6—6 of FIG. 2.
Figure 8:
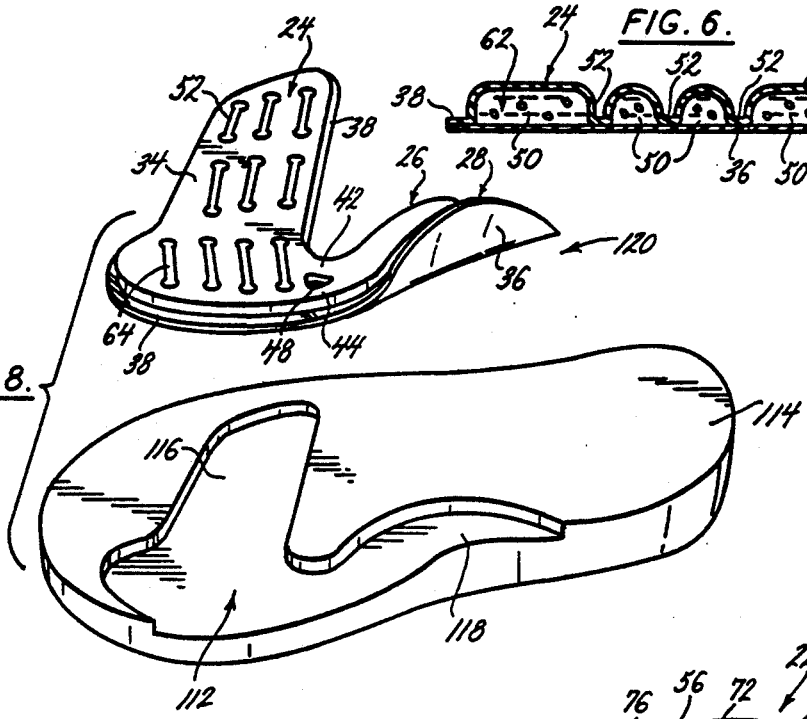
FIG. 8 is a perspective view of the apparatus of FIG. 7 and the shoe sole employed with the apparatus.

A variant embodiment of the apparatus 120 is shown in FIGS. 7 and 8. As seen in the drawing figures, this embodiment of the apparatus 120 is substantially the same as the previously described embodiment except that the heel bladder 32 of the previously described embodiment is removed from the embodiment of the apparatus 120 shown in the drawing figures. The remaining component parts of the apparatus 120 are identical to that of the previously described embodiment and are identified by the same reference numbers as the previously described embodiment.

The variant embodiment of the apparatus 120 is comprised of only the forefoot bladder 24 and the arch bladders 26, 28. The forefoot and arch bladders are formed by the overlapping layers 34, 36 of flexible, fluid-tight material. The layers of material are sealed together around the peripheral boundary of the apparatus 120 by a sealed flange 38 that extends around the peripheral boundary of the apparatus. Just as in the first embodiment of the apparatus, the forefoot bladder 24 and the arch and upper arch bladders 26, 28 are connected in fluid communication by a pair of calibrated fluid-conducting channels 42, 44 separated by a sealed area 48.

Just as in the first embodiment, a first plurality of clefts 52 are formed in the top layer 34 of the forefoot bladder 24 and a second plurality of clefts 54 are formed in the top layer 34 of the arch and upper arch bladders 26, 28. The first plurality of clefts 52 and the second plurality of clefts 54 are arranged in their respective bladders in the same manner as the previously described embodiment and perform the same functions as the previously described embodiment. Just as in the first described embodiment, an additional cleft 64 is provided on the top layer of the forefoot bladder 24 in the area of the hallux digit. The interior volumes of the forefoot bladder 24 and arch bladders 26, 28 are filled with the same fluid 50 as the first described embodiment of the apparatus.

The apparatus of the invention 120 shown in FIGS. 7 and 8 is received in a shoe sole in substantially the same manner as the first described embodiment of the invention. Shown in FIG. 8 is a shoe sole having a recessed cavity 112 formed in the top surface of the sole 114. The recessed cavity 112 is given a configuration substantially identical to the configuration of the forefoot bladder 24 and arch bladder 26 of the second embodiment of the apparatus 120. Like the first embodiment, the upper arch bladder 28 of the embodiment shown in FIGS. 7 and 8 is not received in the shoe sole 114, but is mounted on an interior surface of the shoe upper (not shown). The recessed cavity 114 is formed with a forefoot portion 116 shaped to receive the forefoot bladder and a connected arch portion 118 shaped to receive the arch bladder 26. The apparatus 120 is received in the recessed cavity 112 and covered over by the shoe insole (not shown) in substantially the identical manner as described above with reference to the first embodiment of the invention.

Figure 9:
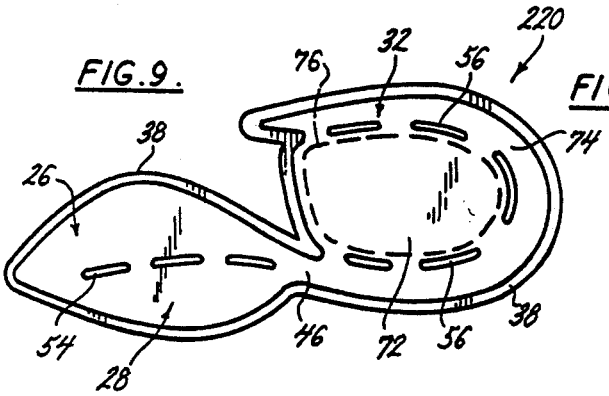
FIG. 9 is a plan view of a variant embodiment of the apparatus of the invention.
Figure 10:
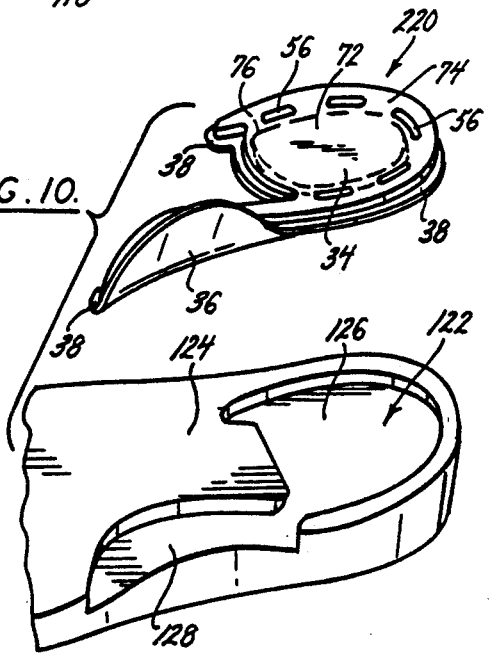
FIG. 10 is a partial perspective view of the apparatus of FIG. 9 and the shoe sole employed with the apparatus.

A further embodiment of the apparatus of the invention 220 is shown in FIGS. 9 and 10 of the drawing figures. This embodiment of the invention is substantially identical to the first embodiment of the invention except for the forefoot bladder being removed from the embodiment of the apparatus shown in FIGS. 9 and 10. The remaining component parts of the embodiment of the apparatus 220 shown in FIGS. 9 and 10 are identical to the component parts of the first embodiment of the apparatus and are identified by the same reference numbers as the component parts of the first embodiment of the apparatus.

The apparatus 220 shown in FIGS. 9 and 10 is comprised of an arch bladder 26, an upper arch bladder 28 and a heel bladder 32. Like the first embodiment, the three bladders are formed by a pair of overlapping layers of flexible, fluid-tight material. The top layer 34 of the material is secured to the bottom layer 36 along the peripheral boundary 38 of the apparatus 220. The sealed peripheral boundary 38 seals the fluid (not shown) in the interior volumes (not shown) of the bladders. The interior volumes of the arch bladders 26, 28 communicate in fluid communication with the interior volume of the heel bladder 32 through the calibrated fluid-conducting channel 46. Just as in the first embodiment of the invention, a plurality of clefts 54 extends between and separate the arch bladder 26 from the upper arch bladder 28 and together form a fold line between these two bladders. An additional plurality of clefts 56 extends around the heel bladder 32 and separate the center chamber 72 of the bladder from the rim chamber 74. The foam sponge pad 76 is contained inside the interior volume of the center chamber 72 of the heel bladder and displaces a portion of the fluid from the center chamber. As in the first embodiment, the pad 76 serves as an additional cushion in the center chamber 72 while reducing the weight of the center chamber by displacing a portion of the fluid.

The embodiment of the apparatus 220 shown in FIGS. 9 and 10 is also received in a recessed cavity 122 formed in the top surface of a shoe sole 124. Like the first embodiment of the invention, the recessed cavity is formed with a configuration complementary to the boundary configuration of the reactive energy apparatus 220. The recessed cavity includes a heel portion 126 for receiving the heel bladder 32 and an arch portion 128 for receiving the arch bladder 26. As in the first embodiment, the arch bladder 26 of the FIGS. 9 and 10 embodiment is received in the arch portion of the cavity 128 and the upper arch bladder 28 is mounted on an interior surface of the shoe upper (not shown) just above the arch bladder 26. With the apparatus 220 received in the recessed cavity 122 of the shoe sole, the shoe insole (not shown) is inserted in the shoe interior over the apparatus.

Figure 11:
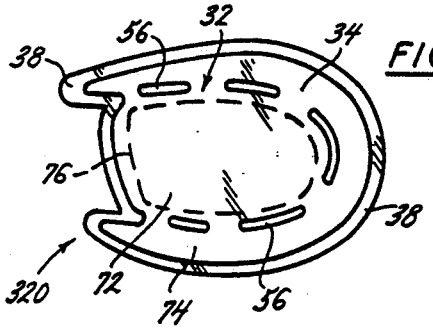
FIG. 11 is a plan view of a variant embodiment of the apparatus of the invention.
Figure 12:
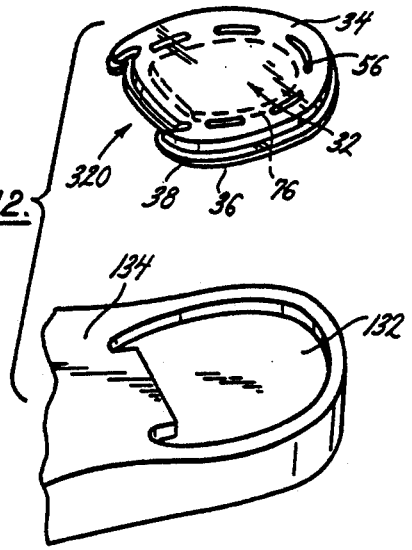
FIG. 12 is a partial perspective view of the apparatus of the invention shown in FIG. 11 and the shoe sole employed with the apparatus.

FIGS. 11 and 12 show a still further embodiment of the reactive energy apparatus of the invention. The embodiment of the reactive energy apparatus 320 shown in FIGS. 11 and 12 is substantially identical to the first described embodiment of the apparatus 20 except that the forefoot bladder and both arch bladders are removed. In the embodiment of the apparatus 320 shown in FIGS. 11 and 12, the apparatus is comprised of the heel bladder 32 only. The construction of the heel bladder 32 is substantially identical to that of the first described embodiment of the apparatus. The heel bladder of FIGS. 11 and 12 is constructed from an overlapping top layer 34 and bottom layer 36 of flexible, fluid-tight, barrier material. The overlapping layers of material are sealed around their peripheral boundary 38 enclosing the interior volume of the bladder 32 between the two layers. A plurality of clefts 56 extend downward from the top layer 34 through the interior volume (not shown) of the bladder, and are joined to the bottom layer 36 of the bladder. As in the first embodiment, the plurality of clefts 56 secure the top layer to the bottom layer in spaced relation, and also separate the center chamber 72 of the bladder from the rim chamber 74 of the bladder. The spacings in the interior volume of the bladder between adjacent clefts 56 serve as flow-restricting openings. The cross-sectional areas of the spacings between adjacent clefts 56 are calibrated to control the rate of fluid flow between the center chamber 72 and the rim chamber 74. Just as in the first embodiment, when a force is exerted on the top layer 34 in the area of the center chamber 72, the interior volume of the center chamber decreases. The decrease in the volume of the center chamber forces fluid from the center chamber through the calibrated openings between adjacent clefts 56 to the rim chamber 74. The calibrated openings between adjacent clefts 56 restrict the free flow of fluid from the center chamber to the rim chamber, causing a portion of the fluid to remain in the center chamber and cushion the foot heel from the force of footstep impact. The portion of fluid forced from the center chamber through the openings between adjacent clefts into the rim chamber causes the rim chamber to expand. The expansion of the rim chamber exerts a reactive force on portions of the foot heel contacting the top layer 34 in the area of the rim chamber 74, thereby distributing the force of footstep impact over a greater area of the foot heel and stabilizing the foot heel.

As in the first embodiment, the center chamber 74 contains the foam sponge pad 76 in its interior. The foam sponge pad 76 adds additional cushioning to the center chamber 72 and reduces the weight of the heel bladder 32 by displacing a portion of the fluid from the heel bladder interior.

The embodiment of the apparatus 320 shown in FIGS. 11 and 12 is also received in a recessed cavity 132 formed in the heel area of the shoe sole 134. As in the previously described embodiments, the cavity 132 has a configuration complementary to the peripheral boundary configuration of the heel bladder 32. The heel bladder 32 is received in the cavity 132 of the shoe sole 134 and is covered over by an insole (not shown) inserted into the shoe interior.

Figure 13:
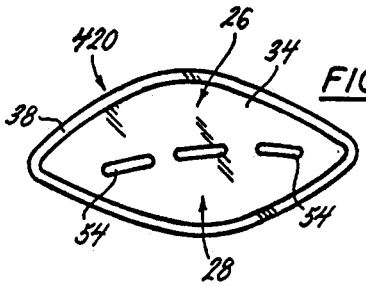
FIG. 13 is a plan view of a variant embodiment of the apparatus of the invention.
Figure 14:
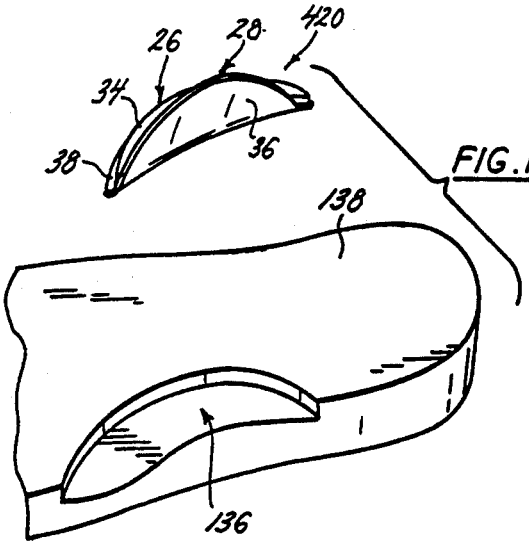
FIG. 14 is a partial perspective view of the apparatus of FIG. 13 and the shoe sole employed with the apparatus.

Drawing FIGS. 13 and 14 show a further embodiment of the apparatus 420 of the invention. The embodiment of the apparatus 420 shown in FIGS. 13 and 14 is substantially identical to the first described embodiment of the apparatus 20 except that the forefoot bladder 24 and heel bladder 32 are removed. The embodiment of the apparatus 420 shown in FIGS. 13 and 14 is comprised of only the arch bladder 26 and the upper arch bladder 28. The apparatus is constructed in substantially the same manner as the first described embodiment in that an overlapping top layer 34 and bottom layer 36 of flexible, fluid-tight, barrier material are sealed together around the peripheral edge 38 of the apparatus. Sealing the peripheral edge 38 of the apparatus encloses the interior volumes of the bladders 26, 28 between the two layers. A plurality of clefts 54 extend across the apparatus 420 and separate the arch bladder 26 from the upper arch bladder 28. As in the first embodiment, the plurality of clefts 54 serve to form a fold line across the apparatus 420 that enables the upper arch bladder 28 to be folded in an upward orientation above the arch bladder 26 when inserting the apparatus in a shoe sole. The openings between adjacent clefts 54 in the interior volume (not shown) of the apparatus are calibrated to control the rate of fluid flow between the arch and upper arch bladders. As in the first described embodiment, the cross-sectional areas of the openings between adjacent clefts 54 in the interior of the apparatus 420 restrict the free flow of fluid between the two bladders. When a force due to footstep impact is exerted on the top layer 34 of one of the two bladders, the interior volume of the bladder is decreased. The decrease in the bladder interior volume forces the fluid from the bladder, through the openings between adjacent clefts 54, to the adjacent bladder. The calibration of the cross-sectional areas between adjacent clefts 54 controls the rate of fluid flow through the cross-sectional areas to maintain a portion of the fluid in the bladder on which the footstep force is exerted to maintain the bladder's ability to cushion and support the arch area of the foot. The flow of fluid from the arch bladder on which the footstep force is exerted to the adjacent arch bladder causes the adjacent arch bladder to expand slightly. The expansion of the adjacent arch bladder causes that bladder to exert a reactive force on the foot in the arch area of the foot. The reactive force exerted by the adjacent bladder serves to distribute the force of footstep impact over a greater area of the arch of the foot and thereby decreases the shock of footstep impact.

As in the previously described embodiments, the embodiment of the apparatus 420 shown in FIGS. 13 and 14 is received in a recessed cavity 136 formed in the shoe sole 138. The recessed cavity 136 has a configuration complementary to the configuration of the arch bladder 26 of the apparatus 420. In positioning the apparatus 420 in the shoe sole, the arch bladder 26 is received in the recessed cavity 136 of the shoe sole 138, and the upper arch bladder 28 is mounted on an interior surface of the shoe upper (not shown) adjacent to and slightly above the arch bladder. The arch bladder 26 and upper arch bladder 28 are then covered over by a shoe insole (not shown) inserted into the shoe interior.

Figure 15:
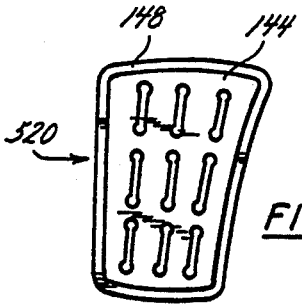
FIG. 15 is a plan view of a variant embodiment of the apparatus of the invention; and, FIG. 16 is a partial perspective view of the apparatus of FIG. 15 and the shoe sole employed with the apparatus.
Figure 16:
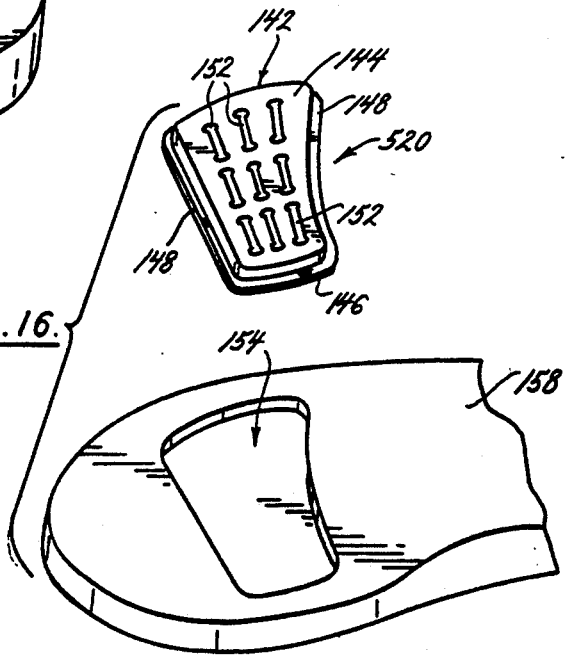

A still further embodiment of the apparatus of the invention is shown in FIGS. 15 and 16. The embodiment of the reactive energy apparatus 520 shown in FIGS. 15 and 16 is substantially identical to the first described embodiment of the apparatus 20 with the arch bladders 26, 28 and the heel bladder 32 removed. The apparatus 520 of FIGS. 15 and 16 is also slightly modified in that the extension of the first described forefoot bladder for the hallux digit is removed. Apart from the just described differences, the reactive energy apparatus 520 of FIGS. 15 and 16 is substantially identical to the forefoot bladder 24 of the first embodiment. The bladder 142 is formed from an overlapping top layer 144 and bottom layer 146 of flexible, fluid-tight, barrier material. The pair of material layers are sealed around their peripheral boundary 148 in the same manner as the first described embodiment of the apparatus. A plurality of clefts 152 are formed in the top layer 144 and extend from the top layer down through the interior volume (not shown) of the bladder 142 to the bottom layer 146. The clefts 152 are joined to the bottom layer 146 of the bladder to connect the top layer to the bottom layer in a spaced relation.

The plurality of clefts 152 are provided in the bladder 142 for the same purposes as the clefts 52 of the first described embodiment. The clefts 152 are arranged in an array of longitudinal columns and lateral rows, forming a plurality of lateral fold lines extending across the bladder 142. The lateral fold lines formed by the plurality of clefts 152 facilitate the ability of the bladder to fold over at the fold lines in response to forces exerted on the bladder in walking, running and other activities. The extension of the clefts 152 through the interior volume (not shown) of the bladder 142 also serves to form a plurality of wall segments in the bladder interior. The plurality of wall segments divide the bladder interior into separate areas separated by the wall segments and communicated with each other by openings between adjacent wall segments of the clefts. The openings between adjacent clefts 152 have calibrated cross-sectional areas that regulate the rate of fluid flow between areas of the bladder interior separated by the clefts. As in the first embodiment of the invention, the calibrated openings between adjacent clefts of the interior of the bladder control the flow of fluid through the bladder to maintain a portion of the fluid in an area of the bladder where a force from footstep impact is exerted, thereby maintaining the cushioning and support for the foot in this area of the bladder. The flow of fluid from the area of the bladder subjected to the force of foot impact, through the openings between adjacent clefts 152, to other areas of the bladder cause the other areas of the bladder to expand. The expansion of the other areas of the bladder results in these areas exerting a reactive force on the bottom of the shoe wearer's foot, thereby distributing the force of footstep impact over a greater area of the bottom of the foot and decreasing the shock of foot impact.

The embodiment of the apparatus 520 shown in FIGS. 15 and 16 is also received in a recessed cavity 154 formed in the forefoot area of the shoe sole 156. The recessed cavity 154 is given a configuration complementary to the configuration of the peripheral boundary 148 of the forefoot bladder 142. The forefoot bladder is inserted into the cavity 156 and is covered over by an insole (not shown) inserted into the shoe interior.

While the present invention has been described by reference to specific embodiments, it should be understood that modifications and variations of the invention may be constructed without departing from the scope of the invention as defined in the following claims.

What is claimed is:

1. A reactive energy fluid cushioning and stabilizing apparatus on a shoe sole, the apparatus comprising:

a shoe sole having forward and rearward ends and a medial side and a lateral side extending between the forward and rearward ends of the shoe sole, the medial and lateral sides extending around the forefoot area of the shoe sole adjacent the sole forward end, a heel area of the shoe sole adjacent the sole rearward end, and an arch area of the shoe sole between the forefoot and heel areas;

at least one hollow bladder on the shoe sole, the bladder having a flexible first wall and a flexible second wall enclosing an interior volume of the bladder therebetween;

a fluid filling the interior volume of the bladder, portions of the fluid being caused to flow from one area of the bladder interior volume to a second area of the bladder interior volume in response to a force being exerted on the bladder;

a plurality of clefts formed in the first wall of the bladder, each cleft extending from the first wall down into the bladder interior volume and through the fluid to the second wall, each cleft having a bottom joined to the second wall thereby connecting the first wall in a spaced relation to the second wall with the fluid filling the interior volume therebetween and thereby forming each of the clefts as an indentation in the first wall of the bladder, the plurality of clefts being arranged in at least one line across the bladder forming a fold line of indentations across the first wall of the bladder that facilitates folding the bladder at the fold line, and the line of clefts extending through the interior volume of the bladder separating the first area of the interior volume from the second area of the interior volume with adjacent clefts in the interior volume having spacings therebetween, the spacings functioning as flow restrictions that limit the rate of fluid flow through the spacing from the one area of the interior volume to the second area of the interior volume;

each of the clefts having a set length extending across the first and second walls and through the interior volume of the bladder, the clefts being arranged end to end in a line across the bladder forming a fold line through the bladder between the first area and the second area of the bladder interior volume and enabling the first area to be folded over the second area at the fold line, the first area of the bladder being configured as a first arch bladder with a configuration complementary to an upper arch area on a medial side of a foot, the configuration of the firs arch bladder positioning it adjacent the medial side of the shoe sole and preventing it from extending across the show sole to the lateral side of the shoe sole, and the second area of the bladder being configured as a second arch bladder with a configuration complementary to a lower arch area on an underside of a foot, the configuration of the second arch bladder positioning it adjacent the first arch bladder and preventing the second arch bladder from extending forward adjacent the forefoot area of the shoe sole or rearward adjacent the heel area of the shoe sole, where together the first and second arch bladders are relatively positioned to engage in surface contact along the medial side and an underside of a foot arch and provide a custom fit, support and cushioning to the foot arch.

2. The apparatus of claim 1, wherein:

the second arch bladder has a configuration to engage under only an arch of a foot adjacent a medial side of the foot and not to extend across the foot to its opposite lateral side.

3. The apparatus of claim 1, wherein:

a forward end of the first and second arch bladders merge into a fluid conducting channel that extends adjacent the medial side of the shoe sole to a third area of the bladder, the third area of the bladder being configured as a forefoot bladder, the forefoot bladder being configured to be received in the forefoot area of the shoe sole with the bladder extending from the fluid conducting channel transversely across the forefoot area of the sole from the medial side to the lateral side of the shoe sole, and the plurality of clefts are arranged end to end in a plurality of lines forming a plurality of fold lines extending across the forefoot bladder with each fold line extending transversely across the forefoot bladder and transversely across the forefoot area of the shoe sole thereby enabling the forefoot bladder to be folded over at each of the plurality of fold lines in response to bending of the forefoot area of the shoe sole in running or walking movements.

4. The apparatus of claim 3, wherein:

the plurality of clefts are arranged in an array on the forefoot bladder with the plurality of lines of clefts forming a plurality of rows of the array and plurality of adjacent clefts in adjacent lines forming a plurality of columns of the array.

5. The apparatus of claim 3, wherein:

each of the clefts has opposite edges at ends of their lengths and opposite sides along their lengths, the plurality of clefts form a plurality of separate areas in the interior volume between mutually opposed sides of the clefts and a plurality of openings in the interior volume between mutually opposed edges of the clefts, the plurality of openings restricting the flow of fluid through the interior volume between the plurality of areas in response to a force being exerted on the forefoot bladder.

6. A reactive energy fluid filled cushioning and stabilizing apparatus on a shoe sole, the apparatus comprising:

a shoe sole forward and rearward ends and a medial side and a lateral side extending between the forward and rearward ends of the shoe sole, the medial and lateral sides extending around a forefoot area of the shoe sole adjacent the sole forward end, a heel area of the shoe sole adjacent the sole rearward end, and an arch area of the shoe sole between the forefoot and heel areas;

at least one hollow bladder on the shoe sole, the bladder having a flexible first wall and a flexible second wall enclosing an interior volume of the bladder therebetween;

a fluid filling the interior volume of the bladder, portions of the fluid being caused to flow from one area of the bladder interior volume to a second area of the bladder interior volume in response to a force being extended on one of the walls of the bladder;

a plurality of interior wall segments spatially arranged inside the interior volume of the bladder; each of the wall segments being connected between the first wall and the second wall, the plurality of wall segments being arranged in at least one line across the bladder where the configuration of each of the wall segments forms a fold line across the bladder that facilitates folding the bladder at the fold line, and the line of wall segments extending through the interior volume of the bladder separating the first area of the interior volume from the second area of the interior volume with adjacent wall segments having spacing therebetween, the spacings functioning as flow restrictions that limit the rate of fluid flow through the spacings from the one area of the interior volume to the second area of the interior volume;

each of the wall segments has a set length extending across the first and second walls and through the interior volume of the bladder, the wall segments being arranged end to end in a line across the bladder forming a fold line through the bladder between the first area and the second area of the bladder interior volume and enabling the first area to be folded over the second area at the fold line, the first area of the bladder being configured as a first arch bladder with a configuration complementary to an upper arch area on a medial side of a foot, the configuration of the first arch bladder positioning it adjacent the medial side of the shoe sole and preventing it from extending across the shoe sole to the lateral side of the shoe sole, and the second area of the bladder being configured as a second arch bladder with a configuration complementary to a lower arch area on an underside of a foot, the configuration of the second arch bladder positioning it adjacent the first arch bladder and preventing the second arch bladder from extending forward adjacent the forefoot area of the shoe sole or rearward adjacent the heel area of the shoe sole, where together the first and second arch bladders are relatively positioned to engage in surface contact along a medial side and an underside of a foot arch and provide a custom fit, support and cushioning to the foot arch.

7. The apparatus of claim 6, wherein:

the second arch bladder is configured to engage under only an arch area of the foot adjacent a medial side of the foot and not to extend across the foot to its opposite lateral side.

8. The apparatus of claim 6, wherein:

a forward end of the first and second arch bladders merge into a fluid conducting channel that extends adjacent the medial side of the shoe sole to a third area of the bladder, the third area of the bladder being configured as a forefoot bladder, the forefoot bladder being configured to be received in the forefoot area of the shoe sole with the bladder extending from the fluid conducting channel transversely across the forefoot area of the sole from the medial side to the lateral side of the shoe sole, and the plurality of wall segments are arranged end to end in a plurality of lines forming a plurality of fold lines extending across the forefoot bladder with each fold line extending transversely across the forefoot bladder and transversely across the forefoot area of the shoe sole thereby enabling the forefoot bladder to be folded over at each of the plurality of fold lines in response to bending of the forefoot area of the shoe sole.

9. The apparatus of claim 8, wherein:

the plurality of wall segments are arranged in an array on the forefoot bladder with the plurality of lines of wall segments forming a plurality of rows of the array and pluralities of adjacent wall segments in adjacent lines forming a plurality of columns of the array.

10. The apparatus of claim 8, wherein:

the set lengths of each of the wall segments have opposite ends and opposite sides along their lengths, the plurality of wall segments define and separate a plurality of separate areas in the bladder interior volume between mutually opposed sides of the wall segments and a plurality of openings in the interior volume between mutually opposed ends of adjacent wall segments, the plurality of openings restricting the flow of fluid through the interior volume between the plurality of separate areas in response to a force being exerted on the forefoot bladder.

11. A reactive energy fluid cushioning and stabilizing apparatus on a shoe sole, the apparatus comprising:

a hollow bladder, the bladder having a flexible first wall and a flexible second wall enclosing an interior volume of the bladder therebetween;

a fluid filling the interior volume of the bladder, portions of the fluid being caused to flow from one area of the bladder interior volume to a second area of the bladder interior volume in response to a force being exerted on the bladder;

a plurality of clefts formed in the first wall of the bladder, each cleft extending from the first wall into the bladder interior volume and through the fluid to the second wall, each cleft having a bottom joined to the second wall thereby connecting the first wall in a spaced relation to the second wall with the fluid filling the interior volume therebetween and thereby forming each of the clefts as an indentation in the first wall of the bladder, the plurality of clefts being arranged in a plurality of lines across the bladder forming fold lines of indentations across the first wall of the bladder that facilitate folding the bladder at the fold lines, and the lines of clefts extending through the interior volume of the bladder with adjacent clefts in the interior volume having spacings therebetween, the spacings functioning as flow restrictions that limit the rate of fluid flow through the spacings from the one area of the interior volume to the second area of the interior volume; and, a forefoot section of the bladder is configured to be received in a forefoot area of a shoe sole with the bladder extending transversely across the forefoot area of the sole from a medial side to a lateral side of the shoe sole, and the plurality of clefts are arranged in the plurality of fold lines with each fold line extending transversely across the bladder and transversely across the forefoot area of the shoe sole thereby enabling the bladder to be folded over at each of the plurality of fold lines in response to bending of the forefoot area of the shoe sole in running or walking movements; and, the bladder is also configured to be received in an arch area of the shoe sole with a first arch bladder section having a configuration complementary to an upper arch area of a medial side of a foot and a second arch bladder section having a configuration complementary to a lower arch area on an underside of a foot, where together the first and second arch bladder sections are relatively positioned to engage in surface contact along the medial side and an underside of a foot arch and provide a custom fit, support and cushioning to the foot arch, the plurality of clefts being arranged end to end in a line across the bladder forming a fold line through the bladder between the first arch bladder section and the second arch bladder section.

12. The apparatus of claim 11, wherein:

the bladder is also configured to be received in a heel area of a shoe sole with a heel bladder section having a configuration complementary to a heel area of a foot, the plurality of clefts being arranged in a line having a general U-shaped configuration defining and separating the heel bladder into a center chamber and a rim chamber where the rim chamber extends uninterrupted in a general U-shaped configuration from a lateral side of the center chamber, around a rear side of the center chamber to a medial side of the center chamber opposite the center chamber lateral side.

13. The apparatus of claim 12, wherein:

the fluid filling the heel bladder section of the bladder is a liquid and a pad is contained inside the interior volume of the heel bladder section, the pad displaces a portion of the liquid from the interior volume and thereby reduces the weight of the heel bladder section.

* * * * *